United States Patent [19]

Bradley

[11] Patent Number: 4,531,993

[45] Date of Patent: Jul. 30, 1985

[54] HIGH SPEED METHOD OF MAKING ENVELOPES EACH WITH A DOUBLE FOLDED REMOVABLE ENCLOSURE

[75] Inventor: William P. Bradley, Hollidaysburg, Pa.

[73] Assignee: Bedford Engineering Co., Armonk, N.Y.

[21] Appl. No.: 574,308

[22] Filed: Jan. 26, 1984

[51] Int. Cl.[3] ..... B65B 63/04

[52] U.S. Cl. ..... 156/227; 156/250; 156/306.3; 282/25; 493/216; 493/223; 493/228; 493/231; 53/460

[58] Field of Search ..... 493/216, 223, 224, 227, 493/228, 231; 282/25; 283/1 B; 53/206, 460

[56] References Cited

U.S. PATENT DOCUMENTS 1,591,231 7/1926 Otis ..... 282/25
3,557,519 1/1971 Lyon ..... 493/216
4,091,596 5/1978 Jones ..... 53/460
4,189,895 2/1980 Volkert et al. ..... 53/206
4,411,643 10/1983 Higginson ..... 493/216

FOREIGN PATENT DOCUMENTS 554661 1/1960 Belgium .

*Primary Examiner*—Caleb Weston
*Attorney, Agent, or Firm*—Herman J. Hohauser

[57] ABSTRACT

An improved high speed method for producing quantities of discrete envelope assemblies, each assembly including an envelope and separate double folded enclosure formed from the same blank of sheet material and having personalized information printed on both the envelope and enclosure that is unique to each assembly.

The method provides for continuous operation of the method steps all occurring one after the other as each assembly travels in the same general direction throughout all processing operations.

15 Claims, 11 Drawing Figures

HIGH SPEED METHOD OF MAKING ENVELOPES EACH WITH A DOUBLE FOLDED REMOVABLE ENCLOSURE

BACKGROUND OF THE INVENTION

1. Field of the Invention

The invention generally relates to the improved high speed method of manufacture of mailing assemblies each of which includes a personalized envelope and separate similarly personalized double folded enclosure formed from the same length of sheet material.

2. Description of the Prior Art

High speed web lithographic printing techniques have given rise over the past few decades to exponential increases in the use of direct mail advertising, this practice having further expanded more recently to include "personalized" letters produced through utilization of computer-controlled printing equipment capable of addressing a letter and even providing personal information previously stored in computer memory. Such prior techniques have expanded the use of direct mail advertising and similar communication by allowing mass mailings to be performed at an extremely low cost relative to previous manual methods. The personalization of mail effectively increases the return to the advertiser or other user. However, the personalization provided to such a letter by this relatively new technology has diminished in impact due to the nature of the envelopes and similar articles onto which the personalized information is printed. Personalized mailings lose a substantial amount of personal value when the person receiving the mailing can easily recognize the mailing as a "form" or "mass" mail advertisement, such poorly-produced mailings being often not opened or read by the recipient even though useful and valuable information is contained in the mailing. The use of "computer print-out" papers wherein an envelope and "letter" are combined together without detachment and often without even removal of edge perforations remaining from printing from a roll further increases the resistance of a recipient to seriously consider such a mailing as personal mail deserving of close attention. Numerous attempts to improve upon the impersonal "personalized" letter have been made in the art such as is evidenced by U.S. Pat. No. 3,557,519 to Lyon, Jr., who describes an integral envelope-letter article intended to provide the effect of a personal letter while retaining the ability to produce such letters in sufficient quantities to be economical within the economic framework of direct mail advertising. As a further example, Jones, in U.S. Pat. No. 4,091,596, provides a method for producing a mailing piece formed of an envelope and an insert. However, the Jones mailing piece is formed of two separate sheets of material blanked from different webs at different locations and mated in an assembly operation, such methodology being logistically difficult and of a speed which is becoming unacceptable in the industry due to cost considerations. Jones particularly provides two changes of direction in the manufacture of the mailing piece so disclosed, a first change of direction occurring on insertion of the separate "letter" portion of the mailing piece into an unglued blank with a second change of direction occurring to facilitate application of adhesive to the envelope blank which is followed by folding and sealing of the mailing piece. Changes of direction in such a processing operation inherently increase the time required for manufacture of a mailing piece. Volkert et al, in U.S. Pat. No. 4,189,895, provides a further example of the manufacture of mass mailing pieces which can be computer-personalized. Volkert et al provide an envelope containing a personalized enclosure which is unattached to the personalized envelope, the envelope and enclosure being formed from the same web of sheet material which has been preprinted. Volkert et al do not provide a mechanism within the mailing piece itself during formation which ensures that the envelope and enclosures are maintained in association with each other during folding and severing operations necessary to cause the envelope and enclosure to become separate entities.

Accordingly, it has become highly desirable to produce personalized mailing pieces consisting of a personalized envelope and a separate personalized enclosure which are formed from the same preprinted blank of sheet material and which particularly gives the effect of an important, personalized letter or other communication such as a telegram or the like. Further, it is particularly necessary in the production of such mailing pieces that the mailing pieces be produced at a high rate of speed in order that economies can be effected without diminution of the personalized quality of the mailing. The present invention addresses these needs by formation of a personalized mailing assembly comprised of an envelope and separate double folded enclosure which can be produced in large quantities and at extremely rapid rates of production, thereby allowing the cost of a high personal impact mailing to be produced at a relatively low cost.

SUMMARY OF THE INVENTION

The present invention provides a particular improved method and a variation of the method for producing mass high speed extremely large quantities of discrete mailing assemblies including an envelope and a separate double-folded enclosure formed from the same blank of sheet material. The invention further contemplates the "personalization" of both the envelope and enclosure by preprinting of the blank of sheet material prior to any operational procedures.

The personalized sheet material may be brought to the site of performance of the improved methods in various forms. In the preferred embodiment stacks of pre-cut pieces of sheet material referred to as blanks are provided. Each blank consists of a single thickness of sheet material such as paper or the like and include portions that will eventually be formed into an envelope and separate double-folded enclosure. An alternative to the use of pre-cut blanks includes the provision of a continuous roll or equivalent length of sheet material which is cut into single thickness sheets or blanks personalized with appropriate indicia.

Each blank is transported one at a time at extremely high speed to the first of nine basic operational stations. At that station the blank is subjected to perforation of other equivalent operation such as scoring or the like. Specifically, two perforation lines are formed; one that precisely defines the junction of the envelope portion of the blank and enclosure portion of the blank, and the other than defines the precise location at which the first fold of the enclosure portion occurs.

After the perforation lines are applied the blank is transported to the second station where the enclosure portion of the blank is folded along the perforation line applied at the prior operational station. After this first operational folding procedure the entire enclosure portion of the blank including the first folded portion is folded along the other perforation line. This step is sometimes referred to herein as the third operational procedure.

The fourth operational procedure is the application of adhesive material to the area of the envelope portion of the blank that is referred to as the seal flap of the to-be-formed envelope. At the next operational or fifth station the material immediately adjacent both sides of the performation line forming the junction of the envelope portion and enclosure portion of the blank is severed resulting in the separation of the envelope portion from the enclosure portion so that the once single piece of sheet material is then two separate sheets, the envelope sheet and enclosure sheet.

The once blank mailing assembly, now two sheet assembly is then transported to the sixth or scoring station at which location four separate score lines are applied to the envelope sheet. One of the four scorelines is simultaneously applied to the enclosure sheet and defines on the enclosure sheet the location at which the enclosure will subsequently be folded inside the envelope. Two of the four scorelines on the envelope sheet serve to define the two side flaps of the to-be-formed envelope. The third scorelines on the envelope sheet defines the seal flap of the to-be-formed envelope. The fourth scoreline is formed at the location of the envelope sheet that is to become the bottom closed edge of the envelope. This fourth scoreline and the scoreline applied to the enclosure sheet are located next to each other as the two sheets lie one upon the other in the multi-layer sheet material configuration.

The entire mailing assembly consisting of the double layer of the now separated envelope and enclosure sheet material is moved to the seventh or side-flap folding station. The side flaps of the envelope sheet are folded along the two side flap scorelines such they lie flat against the main portion of the envelope sheet and adjacent to the enclosure sheet.

At the eighth operational location adhesive material is applied to the exposed surfaces of the two side flaps of the envelope sheet. Thereafter, the entire mailing assembly is transported to the ninth station whereupon both the envelope sheet and enclosure sheet are simultaneously folded along the respective scorelines so that the entire enclosure sheet becomes entirely disposed within the envelope sheet. The appropriate edges of the envelope sheet are sealed to the adhesive of the side flaps after the folding resulting in a completely formed envelope with the seal flap open and a separate double folded enclosure located therein.

It is significant to note that as the mailing assembly is transported from the fifth operational station to the sixth through ninth operational stations the then separated envelope sheet and enclosure sheet remain in close contact with each other and do not move relative to each other during the process steps. It is also significant and most important to understand that during the entire process starting from the first perforation operation to the ninth folding operation the travel of the mailing assembly, initially as a one piece blank and then as a two sheet assembly, is continuous and consistently in the same general direction. That is, as the blank is moved from one location to the next it never stops and always advances in the same advancing direction much like the operation of a conveyor belt system. This feature is unlike the operation of other systems wherein folding is accomplished by transporting the work product at sharp angles to the general direction of travel of such work product. Because the direction of travel is singular and continuous extremely high speeds of operation is attained resulting in the production of large quantities of mailing assemblies in a relatively short time period.

Accordingly, it is an object of the present invention to provide a method for producing quantities of discrete envelope assemblies including at least one double folded enclosure which is separate from the envelope, the envelope assemblies being produced at extremely high speeds from a preprinted web of sheet material with the web of sheet material and elements severed from the web traveling in a singular direction throughout manufacture.

It is another object of the invention to provide a method for producing large quantities of mailing pieces formed of separate envelopes and enclosures and wherein the envelope and enclosure is formed from the same sheet of material and which allows the marking of both the envelope and enclosure with indicia which can be unique to each mailing piece.

Further objects and advantages of the invention will become more readily apparent in light of the following detailed description of the preferred embodiment.

DESCRIPTION OF THE PREFERRED EMBODIMENTS

Figure 1:
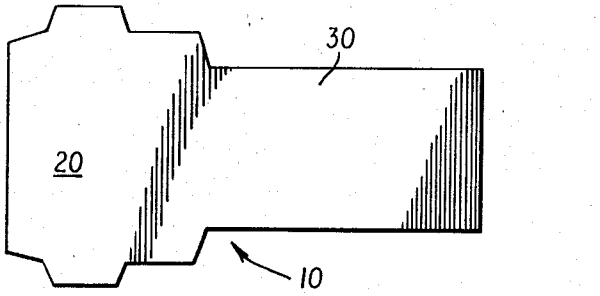
FIG. 1 is a schematic view of a single pre-cut blank from which an envelope with separate enclosure is formed prior to any of the inventive processing operations being performed.

Referring now to the drawing, a preferred method of the invention is schematically illustrated for ease of understanding the basic steps by which the invention allows extremely rapid production of personalized mailing pieces configured in accordance with the structure of the article of the invention. A single blank 10 of pre-cut paper material is seen in FIG. 1. The blank 10 can be transported from a stack of blanks or formed from a continuous paper web that can be produced by conventional computer-controlled lithography technology. In the preferred practice of the method of manufacture the blank 10 is one of a large quantity that is brought to the site of performance in prearranged stacks. As is explained in more detail below each blank 10 consists of a single layer of sheet material, usually paper or the like, which will eventually be formed into an individual envelope and separate double-folded enclosure.

In the instance that the blank 10 is formed from a continuous paper web such web is typically brought to the site of performance of the present methods in a roll-like conformation. The web is fed from the roll or other storage configuration and onto apparatus capable of providing the particular methods steps of the invention.

Whether the individual blank 10 is formed from a web or brought to the performance site included in a stack of many other pre-cut blanks it is to be understood that the process converting such blank into an envelope with a separate insert both including the "personalized" information is accomplished via the use of modified conventional envelope machinery in which standard and well-known procedures and apparatus are arranged to result in the inventive process. For that reason disclosure of such conventional "hardware" is not deemed to be necessary. Reference can be made to the patents discussed in the above description of the prior art wherein many of the operations are disclosed and explained. Reviewing those patents and others in the prior art it can be appreciated that such operations such as folding, scoring, perforating, adhesive application and cutting can be done in any of several conventional ways. The procedural order of these operational steps in the instant system is a significant aspect of this invention. Accordingly, the following detailed description will not include explanation of the particular apparatus used to accomplish various operations on the sheet material. Further, the detailed description is directed to operational procedures performed on a single blank. It is to be understood that the same operational procedures will be applied to other blanks continuously one after another in extremely rapid succession. Still further, it is to be understood that each blank travels continuously in the same general direction throughout the entire process. For purposes of simplicity and clarity mention will not hereinafter be made of the fact that the particular operational apparatus is not shown.

Referring again to FIG. 1 blank 10, a pre-cut single sheet of material, generally of paper like quality, is seen to include an envelope portion 20 and an enclosure portion 30. Generally any printing or other information including the personalization necessary for the mailing of the finished envelope assembly such as the name and address of the proposed recipient is provided before the practice of the hereafter explained process. Since this invention is not concerned with how or when the information is printed on the blanks. Accordingly, it is possible to perform the process with a blank that has no printing or other information should such situation be deemed desirable.

It is to be understood that the blank, as seen in FIG. 1, is transported at extremely high speed from a stack of pre-cut blanks, in the preferred embodiment, or from a continuous web, in an alternative embodiment, and is subsequently moved to each of the operational stations at the same speed. Other blanks immediately replace and follow blank 10 one-at-a-time through the entire manufacturing process. Accordingly, the description of the inventive process will be described with respect to the single blank 10 with the knowledge that the operational procedures are repeated as the next blank is provided in the continuing process.

Figure 2:
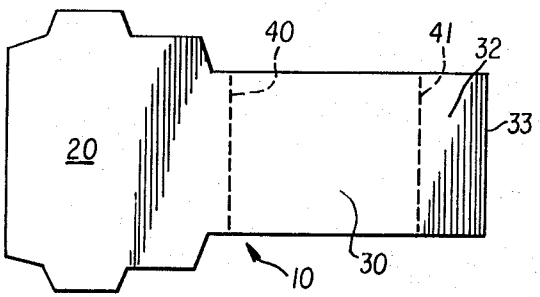
FIG. 2 is a schematic view of the blank after the first processing step consisting of the application of two perforation lines has been accomplished.

To begin the process blank 10 is moved to the first station where it is subjected to a perforation operation. As can be seen in FIG. 2 perforations line 40 and 41 are formed on blank 10. Line 40 is located at the juncture of the envelope portion 20 and adjacent enclosure portion 30 and thus serves to substantially define that portion 20 of the blank 10 which becomes the envelope from that portion 30 of the blank 10 which becomes the enclosure. Perforation line 41 is located on enclosure portion 30 and as is explained in greater detail below serves to define a first panel 32 of the enclosure portion 30.

While perforation operation is preferred it is possible to use other operational procedures known in the art to provide a functional equivalent to the perforation lines. For example, the blank 10 could be subjected to a scoring operation to result in a scoreline in lieu of the perforation lines 40 and 41. The use of other equivalent operations in this regard is considered beyond the scope of this invention and hereinafter, the reference to perforating can be taken to include scoring or other similar operations.

Figure 3:
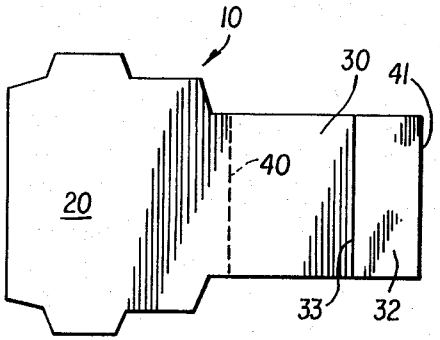
FIG. 3 is a schematic view of the blank after the second processing step consisting of the first folding of the enclosure portion of the blank along the appropriate perforation line has been accomplished.

After the perforation lines are applied, blank 10 is transported in the same direction to a folding station at which time the first panel 32 of enclosure portion 30 is folded along perforation line 41. The result of this folding is seen in FIG. 3 wherein bottom edge 33 of blank 10 is then located between perforation line 40 and perforation line 41. At this location in the manufacturing process the blank 10 remains a single layer of sheet material except for the area on enclosure portion 30 that is a double layer of sheet material including panel 32 of enclosure portion 30.

Blank 10 is then transported in the same directed to a second folding station at which time the enclosure portion 30 including the already folded panel 32 is folded over the envelope portion 20 along the perforation line 40. After this second folding operation the blank 10 consists of a multi-layered assembly of sheet material with panel 32 located between envelope portion 20 and the remainder of enclosure portion 30.

Figure 4:
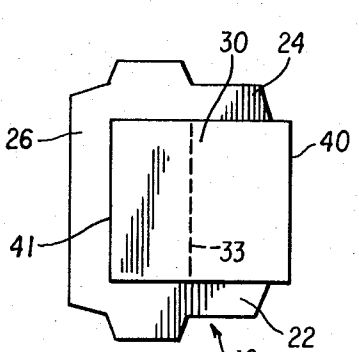
FIG. 4 is a schematic view of the blank after the third processing step consisting of the folding of the blank along the perforation line defining the junction of the envelope portion and enclosure portion.

In the folded condition enclosure portion 30 substantially covers envelope portion 20. As can be seen in FIG. 4 side edge areas 22 and 24 and seal flap edge area 26 are the only areas that are not covered by enclosure portion 30.

Figure 5:
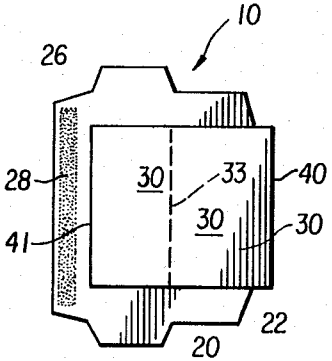
FIG. 5 is a schematic view of the blank after the fourth processing step consisting of the application of adhesive material.

Once blank 10 is in the folded condition shown in FIG. 4 in the preferred practice of the invention it is transported to the next operation at which time adhesive material is applied. Referring to FIG. 5 it is seen that adhesive material 28 is then located only on a portion of flap edge area 26. The adhesive material 28 may be any known gumming material conventionally used in the envelope making industry and is not per se considered to be part of the inventive system. In an alternative process, the application of adhesive material 28 can be delayed to a later operation. As will be explained below such delay is occassioned when it is desirable to completely seal the to-be-formed envelope and enclosure as the last step in the manufacturing process. It is noted that the direct of travel of blank 10 from the folded condition of FIG. 4 to the operation station of adhesive material application is the same as the previous direction of travel of blank 10 and that the movement of blank 10 in the actual process remains continuous.

Figure 6:
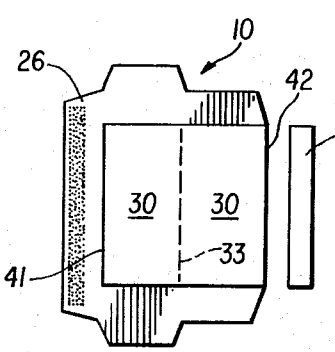
FIG. 6 is a schematic view of the blank after the fifth processing step consisting of the severing operation.

The next operational step involves the shearing or cutting of a substantially rectangular portion 44 from the folded blank 10 at location 42 (see FIG. 6). Portion 44 is essentially a small quantity of sheet material which includes strips from both the envelope portion 20 and enclosure portion 30 on each side of the perforation line 40. In other words, the shearing operation removes the sheet material from blank 10 connecting the envelope portion 20 and enclosure portion 30 on each side of the perforation line 40. After the shearing operation, the envelope portion 20 is no longer integral with the enclosure portion 30. It is to be noted, however, that the now separated portions 20 and 30 of blank 10 remain in position relative to each other during the course of the next three operations as will be explained in more detail below. Since portions 20 and 30 are separated hereinafter they will be referred to as envelope sheet 20 and enclosure sheet 30 respectively.

Figure 7:
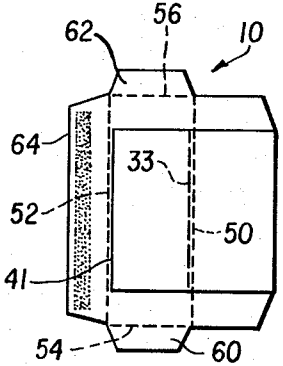
FIG. 7 is a schematic view of the blank after the sixth processing step consisting of the application of score lines.

Upon being transported from the shearing operation sheets 20 and 30 become scored as can best be seen in FIG. 7. Four separate scorelines 50, 52, 54 and 56 are applied in the locations shown. Scoreline 50 is applied to both enclosure sheet 30 and envelope sheet 20 while the scoreline 52, 54 and 56 are placed on only the envelope sheet 20. It should be apparent that the scorelines may be applied all at once, one at a time in various sequence or other combinations of two or more at a time. In the preferred embodiment scorelines 50 and 52 are simultaneously applied before scorelines 54 and 56 which are also simultaneously applied.

Scoreline 50 serves to define the bottom edge of the to be formed envelope on envelope sheet 20 and also serves to define the line upon which the enclosure sheet 30 is eventually folded a second time as will be explained below. Scoreline 52 serves to define seal flap 64 located on seal flap area 26 of envelope sheet 20. Scorelines 54 and 56 serve to substantially define those portions of side edge areas 22 and 24 respectively of envelope sheet 20 that are the side flaps 60 and 62 respectively of the to be formed envelope. It is noted that bottom edge 33 and perforation line 41 of enclosure sheet 30 is located within the boundries formed by scoreline 50 and 52 as best seen in FIG. 7.

Figure 9:
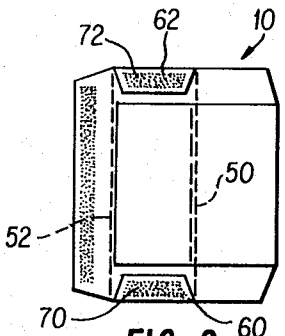
FIG. 9 is a schematic view of the blank after the eighth processing step consisting of the application of adhesive material to the side flaps of the envelope sheet.
Figure 8:
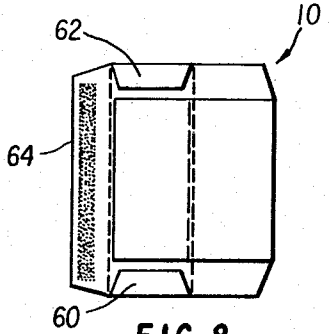
FIG. 8 is a schematic view of the blank after the seventh processing step consisting of the folding of the side flaps of the envelope sheet.

After the scorelines 50, 52, 54 and 56 are applied sheets 20 and 30 are moved to the next operational station at which location side flaps 60 and 62 are folded as shown in FIG. 8 along scorelines 54 and 56 respectively. Thereafter the entire assembly comprised of envelope sheet 20 and enclosure sheet 30 is transported to an adhesive application station where adhesive material 70 and 72 are applied to the exposed surfaces of side flaps 60 and 62 respectively as is shown in FIG. 9. If, adhesive material 28 had not been applied to flap edge area 26 earlier in the manufacturing process as discussed above it is applied along with adhesive material 70 and 72.

Figure 10:
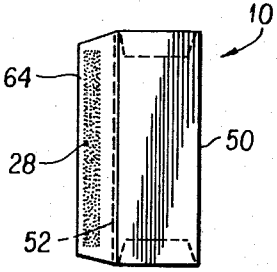
FIG. 10 is a schematic view of the blank after the ninth processing step consisting of the folding and sealing of the side flaps of the envelope.

Subsequent to the adhesive application to side flaps 60 and 62 the portions of envelope sheet 20 and enclosure sheet 30 located to the right of scoreline 50 as viewed in FIG. 9 are folded simultaneously along scoreline 50 as shown in FIG. 10. It will be appreciated that the side edge areas 22 and 24 of envelope sheet 20 located to the right of scoreline 50 (as viewed in FIG. 9) comes into contact with adhesive material 70 and 72 respectively to form a complete envelope with the enclosure sheet 30 completely covered and disposed therein.

Figure 11:
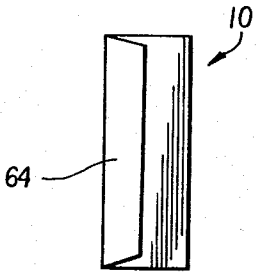
FIG. 11 is a schematic view of the blank after the tenth processing step consisting of the folding and sealing of the seal flap of the envelope.

The last operational procedure consists of folding side flap 64 along scoreline 52 to completely seal the envelope as seen in FIG. 11. It is to be understood that if adhesive material 28 is applied before the severing of portion 44 there is the likelihood that by the time it reaches the last folding procedure illustrated by FIG. 11 that adhesive material 28 will have lost its sticking quality. In that event a remoistening of adhesive material 28 is accomplished before the seal flap 64 is folded.

In the instance wherein other inserts are to be placed in the envelope before final closing of seal flap 64 the envelope with enclosure 30 as seen in FIG. 10 is transported to an insertion station. Such insertion procedures are beyond the scope of the present invention and therefore are not described herein.

The present invention thus provides methods for the high speed manufacture of discrete envelope assemblies or mailing pieces each comprised of an envelope having a double-folded, separate easily removable enclosure formed from the same blank of sheet material. Further, should unique personalization including the matching of the names and addresses of proposed recipients on the envelope and enclosure of each mailing assembly be provided it is crucial that the enclosure have the same name and address as that on the envelope. It can be appreciated that such match-up is assurred through use of the present invention. The present methods particularly allow the continuous, high speed manufacture of personalized mailing pieces in large volumes and at relatively low cost. It is to be further stressed that the ability of the present methodology to be practiced at high speeds derives in part from the fact that all the direction of travel of the blank 10 from the first to last processing operation occurrs in the same general direction as explained above. It is further understood that the invention can be practiced other than as is explicitly described herein, the scope of the invention being defined by the appended claims.

What is claimed is:

1. A method of forming an envelope with a separate enclosure from a single sheet of material having the progressively occurring steps of a. folding said sheet a first time to form a first panel and a double layer of sheet material with said first panel being one of said layers;

b. folding said sheet a second time so that a triple layer of sheet material is formed with said first panel being the middle layer of said triple layer;

c. severing and removing a portion of said sheet after the second fold to form two separate pieces of sheet material;

d. simultaneously folding said two pieces of resulting sheet material to form an envelope having a removable enclosure.

2. The method of claim 1 wherein four scorelines are formed on one of said two separate pieces of sheet material after the severing and removal of said portion of said sheet.

3. The method of claim 1 further comprising the step of simultaneously folding two portions of one of said separated pieces of sheet material before the simultaneous folding of both pieces of sheet material.

4. The method of claim 3 wherein four scorelines are formed on one of said two separate pieces of sheet material after the severing and removal of said portion of said sheet.

5. The method of claim 3 further comprising the step of applying adhesive material to portions of one of said separate pieces of sheet material before the simultaneous folding of both pieces of sheet material.

6. The method of claim 5 wherein said adhesive material is applied to the two portions of one of said separate pieces folded simultaneously before the simultaneous folding of both pieces of sheet material.

7. The method of claim 6 wherein four scorelines are formed on one of said two separate pieces of sheet material after the severing and removal of said portion of sheet material.

8. The method of claim 5 wherein four scorelines are formed on one of said two separate pieces of sheet material after the severing and removal of said portion of said sheet.

9. The method of claim 3 wherein four scorelines are formed on one of said two separate pieces of sheet material after the severing and removal of said portion of said sheet.

10. The method of claim 1 wherein scorelines are formed on said two separate pieces of sheet material after step c and before step d.

11. The method of claim 10 wherein four scorelines are formed in one of said two separate pieces of sheet material and one scoreline is formed on the other.

12. A method of forming an envelope with a separate twice-folded removable enclosure from a single sheet of material having the progressively occurring steps of a. forming two perforation lines on said sheet;
b. folding said sheet along one of said perforation lines;
c. folding said sheet along the other of said perforation lines;
d. severing and removing a portion of said sheet to form two separate pieces of said sheet material;
e. forming scorelines in said two separate pieces of sheet material;
f. folding two portions of one of said pieces of sheet material along respective scorelines;
g. applying adhesive to said two folded portions formed in step f;
h. simultaneously folding said two separate pieces of said sheet material to form an envelope with a removable twice-folded enclosure.

13. The method of claim 12 wherein one scoreline is formed on one of the separate pieces of sheet material as a result of step e.

14. The method of claim 12 wherein four scorelines are formed in one of the separate pieces of sheet material as a result of step e.

15. The method of claim 14 wherein one scoreline is formed on the other of the separate pieces of sheet material.

* * * * *

UNITED STATES PATENT AND TRADEMARK OFFICE

CERTIFICATE OF CORRECTION

PATENT NO. : 4,531,993
DATED : July 30, 1985

INVENTOR(S) : William P. Bradley

It is certified that error appears in the above—identified patent and that said Letters Patent is hereby corrected as shown below:

In Column 2, line 58 "of" should read --or--.

In Column 3, line 11 "performation" should read --perforation--; in line 26 "scorelines" should read --scoreline--; and in line 38 between "such" and "they" insert --that--.

In Column 5, line 21 "methods" should read --method--; in line 36 insert --By-- immediately preceding "reviewing"; in line 37 between "operations" and "as" delete "such"; and in line 65 after "blanks" insert --, the method of printing such indicia will not be described herein.--

In Column 6, line 15 "perforations line" should read --perforation lines--; and in line 45 "directed" should read --direction--.

In Column 7, line 1 "occassioned" should read --occasioned--; in line 4 "direct" should read --direction--; in line 32 "scoreline" should read --scorelines--; in line 35 "sequence" should read --sequences--; in line 51 "scoreline" should read --scorelines--; in line 59 "are" should read --is--; and in line 60 delete the comma between "If" and "adhesive".

In Column 8, line 4 "comes" should read --come--; and in line 41 "occurrs" should read --occurs--.

Signed and Sealed this

Seventh Day of April, 1987

*Attest:*

DONALD J. QUIGG

*Attesting Officer*

*Commissioner of Patents and Trademarks*